US005199780A

United States Patent [19]

Ekman

[11] Patent Number: 5,199,780

[45] Date of Patent: Apr. 6, 1993

[54] FLASHLIGHT HAT CLIP

[76] Inventor: John M. Ekman, 11520 SW. Champlin La., Beaverton, Oreg. 97007

[21] Appl. No.: 836,203

[22] Filed: Feb. 14, 1992

[51] Int. Cl.[5] ..... F21L 15/14

[52] U.S. Cl. ..... 362/106

[58] Field of Search ..... 362/105, 106, 103, 288, 362/287, 427, 285, 418

[56] References Cited

U.S. PATENT DOCUMENTS

| | | | |
|---|---|---|---|
| 2,524,881 | 10/1950 | Chambers | 362/106 |
| 2,765,398 | 10/1956 | Mays | 362/105 |
| 3,032,647 | 5/1962 | Wansky et al. | 362/106 |
| 4,406,040 | 9/1983 | Cannone | 362/106 |

FOREIGN PATENT DOCUMENTS

| | | | |
|---|---|---|---|
| 729240 | 11/1942 | Fed. Rep. of Germany | 362/106 |

*Primary Examiner*—James C. Yeung

*Attorney, Agent, or Firm*—Robert M. Sperry

[57] ABSTRACT

An improved flashlight hat attachment device comprising attachment means engagable with the edge of a hat to attach the device to the hat and having a first support member engagable with the users head to firmly position said device and a flashlight support member projecting outwardly from said first support member and carrying a plurality of flashlight gripping fingers curved to releasably retain a flashlight between said fingers to support said flashlight in a desired position.

8 Claims, 1 Drawing Sheet

FLASHLIGHT HAT CLIP

BACKGROUND

1. Field of Invention

This invention relates to flashlights and is particularly directed to improved clip means for attaching a flashlight to a hat or cap to allow the user free use of both hands.

2. Prior Art

Flashlights have long been popular as portable light sources. Flashlights are compact, light weight and easy to manipulate to enable the user to aim the light in a desired direction. Thus, for many purposes, the flashlights of the prior art have been satisfactory. However, one disadvantage of prior art flashlights has been the fact that they are not self-supporting or self-positioning. In other words, it is generally necessary for the user to hold the flashlight in one hand in order to carry or aim the flashlight. However, if the flashlight must be carried for an extended time, it can become burdensome. Moreover, if the user need to use both hands for carrying other items or for performing a desired task, he may not have a hand free to carry or aim the flashlight. A typical example of this would be where the user must work on an automobile engine at night. He may be working in a relatively inaccessible location and may need both hands for manipulating tools or the like. Thus, he cannot keep one hand free to hold and aim the flashlight and, frequently, there is no other person available to assist and no way to support the flashlight to illuminate the work area. Various means have been proposed heretofore to overcome these problems. It has been proposed to provide feet for holding the front end of the flashlight at a desired elevation above a supporting surface. Obviously, however, this is only useful when a supporting surface is available. Numerous types of straps or brackets have also been proposed for supporting flashlights. Unfortunately, most of these devices serve to support a flashlight only in one or a limited number of fixed positions. Consequently, such straps and brackets are not useful for supporting a flashlight while tracking a moving target or where it may be necessary to change the direction of aiming. To overcome these problems, some prior art devices have been proposed for mounting a flashlight on a hat or cap, which is worn on the user's head so that the user can have free use of both hands, yet can support the flashlight and can aim the flashlight by moving his head. However, many of the prior art hat attachment devices have been relied upon resilient means, such as spring clips, for attaching the flashlight to the hat. Unfortunately, many of these spring clip devices have insufficient strength to firmly retain the flashlight and, hence, are subject to slipping or actually falling off of the hat. Moreover, even where the strength of the spring clip is initially adequate, these clips tend to loosen with time and use and, eventually, become subject to the disadvantages listed above. Furthermore, many of the prior art flashlight hat attachment means have required substantial permanent alteration or modification of the hat or cap or have been bulky, fragile, complex in construction and expensive to purchase or have failed to provide a firm and steady support for the flashlight. Also, many of the prior art flashlight hat attachment means cannot be removed, once they have been installed. A search in the United States Patent Office has revealed the following:

| PATENT NO. | INVENTOR | ISSUED |
|---|---|---|
| 4,991,068 | S. A. Mickey | Feb. 5, 1991 |
| 4,406,040 | R. P. Cannone | Sep. 27, 1983 |
| 3,032,647 | M. H. Wansky et al | May 1, 1962 |
| 2,524,881 | H. F. Chambers | Oct. 18, 1950 |

Each of these references is subject to the disadvantages listed above. Thus, none of the prior art flashlight hat attachment means have been entirely satisfactory.

BRIEF SUMMARY AND OBJECTS OF INVENTION

These disadvantages of the prior art are overcome with the present invention and an improved flashlight hat attachment means is provided which may be permanently or releasably attached to a hat or cap and which will firmly and steadily support a flashlight in a desired position, yet which is simple in construction and inexpensive to purchase and which will not become loosened after extended use.

The advantages of the present invention are preferably attained by providing an improved flashlight hat attachment device comprising attachment means engagable with the edge of a hat to attach the device to the hat and having a first support member engagable with the users head to firmly position said device and a flashlight support member projecting outwardly from said first support member and carrying a plurality of flashlight gripping fingers curved to releasably retain a flashlight between said fingers to support said flashlight in a desired position.

Accordingly, it is an object of the present invention to provide an improved flashlight supporting device.

Another object of the present invention is to provide an improved device for attaching a flashlight to a hat.

An additional object of the present invention is to provide an improved flashlight supporting device which may be permanently or releasably attached to a hat or cap.

A further object of the present invention is to provide an improved flashlight supporting device which will firmly and steadily support a flashlight in a desired position.

Yet another object of the present invention is to provide an improved flashlight supporting device which is simple in construction and inexpensive to purchase and which will not become loosened after extended use.

A specific object of the present invention is to provide an improved flashlight hat attachment device comprising attachment means engagable with the edge of a hat to attach the device to the hat and having a first support member engagable with the users head to firmly position said device and a flashlight support member projecting outwardly from said first support member and carrying a plurality of flashlight gripping fingers curved to releasably retain a flashlight between said fingers to support said flashlight in a desired position.

These and other objects and features of the present invention will be apparent from the following detailed description, taken with reference to the figures of the accompanying drawings.

DETAILED DESCRIPTION OF THE INVENTION

Figure 1:
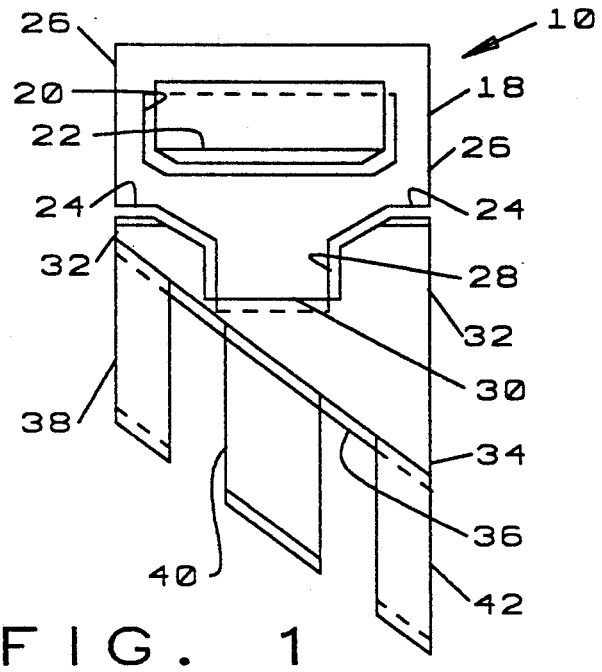
FIG. 1 is a side view of a flashlight attaching device embodying the present invention mounted on a hat.
Figure 2:
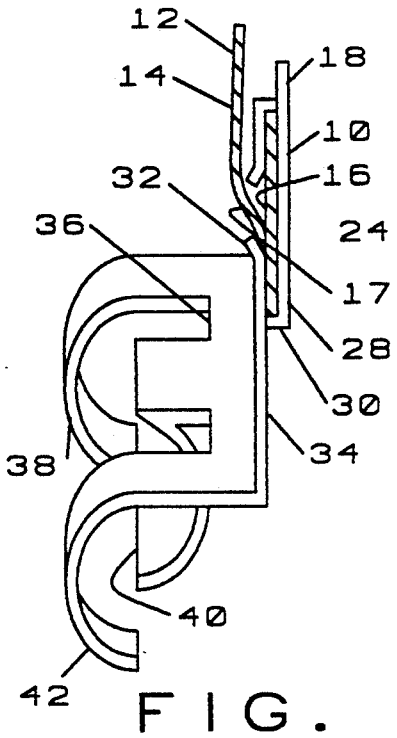
FIG. 2 is a front view, partly in section, showing the flashlight attaching device of FIG. 1.

In that form of the present invention chosen for purposes of illustration in FIGS. 1 and 2, a flashlight attaching device, indicated generally at 10, is shown releasably mounted on a hat, indicated generally at 12, having a crown portion 14 and a headband 16 sewn along the lower edge of the crown portion 14, as seen at 17. The flashlight attaching device 10 comprises a generally vertical rear support member 18 having an opening 20 extending across the upper portion thereof and having a generally L-shaped flap 22 projecting outwardly and downwardly from the upper edge of the opening 20. Also, the lower edges 24 of the rear support member 18 extend angularly inwardly and downwardly from the vertical sides 26 of the rear support member 18 to form a neck portion 28 and a shelf 30 projects substantially perpendicularly outward from the neck portion 28 of the rear support member 18. A pair of tabs 32 project upwardly from a front support member 34 which extends substantially vertically downward from the shelf 30 and a ledge 36 projects substantially perpendicularly outwardly from the front support member 34. The ledge 36 preferably inclines forwardly and downwardly at an angle of approximately 45° and carries a plurality of downwardly curving, generally C-shaped, resilient fingers 38, 40 and 42 which serve to releasably retain a flashlight, not shown, between the fingers 38, 40 and 42. As shown, the resilient fingers 38 and 42 curve outwardly, downwardly and inwardly, while resilient finger 40 curves inwardly, downwardly and outwardly to releasably grip the flashlight, not shown, between resilient fingers 38 and 42 and the opposing resilient finger 40.

In use, the flashlight attaching device 10 may be releasably attached to a hat 12, when desired, without requiring any alteration or modification of the hat 12, by user, as would be the case if all of the fingers 38, 40 and 42 were the same length.

In use, the flashlight attaching device 10 may be releasably attached to a hat 12, when desired, without requiring any alteration or modification of the hat 12, by placing the rear support member 18 of the flashlight attaching device 10 inside the hat 12 and inserting the flap 22 so that it overlies the hat band 16 of the hat 12 and extends downwardly between the hat band 16 and the crown 14, while the tabs 32 project upwardly on the outside of the crown 14 of the hat 12, as best seen in FIG. 2, with the lower edges of the crown 14 and hat band 16 resting on the shelf 30. In this way, the rear support member 18 extends substantially parallel to and inside of the hat band 16, so that the rear support member 18 will rest against the user's head, which will serve to retain the flashlight attaching device 10 in its desired orientation. The user then inserts a flashlight, not shown, between the resilient fingers 38, 40 and 42 which serve to releasably retain the flashlight aiming downwardly at an angle of approximately 45° . Thus, the flashlight attaching device 10 will serve to releasably retain the flashlight and to aim the flashlight forwardly and downwardly to illuminate an area in front of the user, while freeing both of the user's hands for other purposes. If the user is walking, the flashlight attaching device 10 will serve to support the flashlight in a manner to illuminate the ground in front of the user. Alternatively, if the user is working on an automobile engine or some other project which requires both hands, the flashlight attaching device 10 serves to support the flashlight aiming forwardly and downwardly to illuminate the work area and, if the user desires to change the direction of aiming, they can readily accomplish this by tilting, turning or otherwise moving their head. Should the user desire to remove the flashlight attaching device 10 from the hat 12, he simply presses the headband 16 downwardly, while urging inwardly on the rear support member 18 of the flashlight attaching device 10 to disengage the headband 16 from the flap 22. Thereafter, the user slides the tabs 32 off of the hat 12 and the flashlight attaching device 10 is removed, leaving the hat 12 substantially in its original condition.

Figure 3:
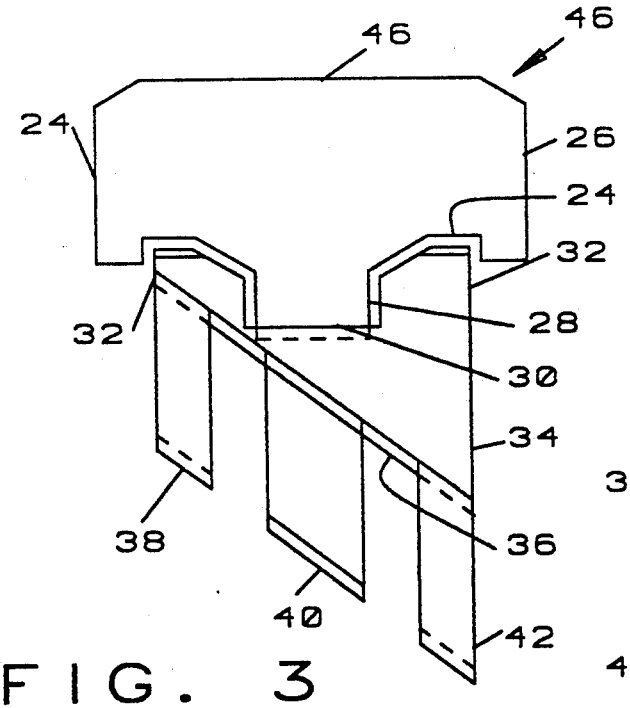
FIG. 3 is a side view of an alternative form of the flashlight attaching device of FIG. 1.
Figure 4:
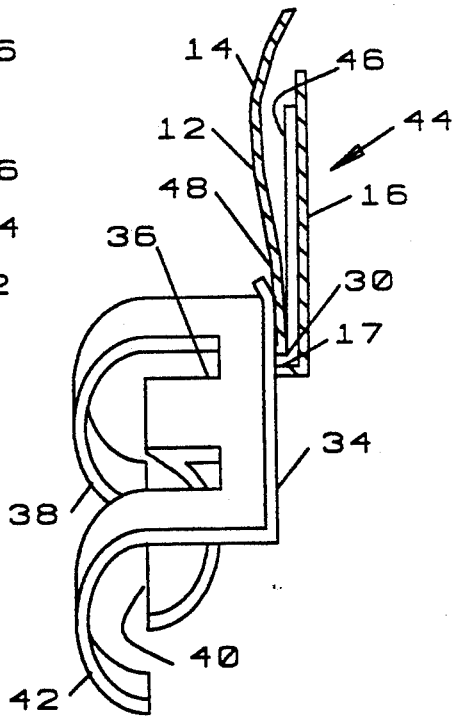
FIG. 4 is a front view, partly in section, showing the flashlight attaching device of FIG. 3.

FIGS. 3 and 4 show an alternative form, indicated generally at 44, of the flashlight attaching device 10 of FIGS. 1 and 2. The flashlight attaching device 44, of FIGS. 3 and 4, is very similar to the flashlight attaching device 10, of FIGS. 1 and 2, except that the rear support member 46 of the flashlight attaching device 44 is considerably wider that the rear support member 18 of the flashlight attaching device 10 and omit the opening 20 and flap 22 of the flashlight attaching device 10 of FIGS. 1 and 2. The flashlight attaching device 44 is intended for permanent mounting on a hat 12 and is attached by forming a suitable slit 48 in the crown 14 of the hat 12, above the stitching 17 which joins the headband 16 to the crown 14, and inserting the rear support member 46 of the flashlight attaching device 44 through the slit 48, to lie parallel to the headband 16 between the headband 16 and the crown 14 of the hat 12. In use, as with the flashlight attaching device 10, of FIGS. 1 and 2, the user's head will bear against the headband 16 and, hence, against the rear support member 46 of the flashlight attaching device 44, to firmly maintain the flashlight, not shown, in a desired position.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A device for attaching a flashlight to a hat, said device comprising a hat having a headband attachment means engagable with a vertical edge of said hat to attach said device to said hat and having a first support member engagable with the user's head to firmly position said device and a flashlight support member projecting outwardly from said first support member and carrying a plurality of flashlight gripping fingers curved to releasably retain a flashlight between said fingers to support said flashlight in a desired position, a flap projecting outwardly and downwardly from said first support member to releasably engage said headband.

2. The device of claim 1 wherein:

said fingers are generally C-shaped.

3. The device of claim 1 wherein:

at least two of said fingers curve in a first direction, and at least one of said fingers curves in a direction opposite to said first direction.

4. The device of claim 3 wherein:

at least one of said fingers curves outwardly, downwardly and inwardly from said flashlight support member, and at least one other of said fingers curves inwardly, downwardly and outwardly from said flashlight support member.

5. The device of claim 1 wherein:

said flashlight support member inclines forwardly and downwardly from said first support member.

6. The device of claim 5 wherein:

said flashlight support member inclines at an angle of approximately 45°.

7. The device of claim 1 wherein:

said flashlight support member carries at least one tab engageable with the outer surface of said hat and cooperating with said first support member to secure said device to said hat.

8. The device of claim 1 wherein:

said flashlight support member serves to aim said flashlight inwardly toward the centerline of the user.

* * * * *